US008943858B2

(12) United States Patent
Burgess

(10) Patent No.: US 8,943,858 B2
(45) Date of Patent: Feb. 3, 2015

(54) CARTRIDGE SYSTEM FOR DISPENSING SUBSTANCES INTO A WASHING MACHINE

(71) Applicant: Ronald Burgess, Temecula, CA (US)

(72) Inventor: Ronald Burgess, Temecula, CA (US)

( * ) Notice: Subject to any disclaimer, the term of this patent is extended or adjusted under 35 U.S.C. 154(b) by 0 days.

(21) Appl. No.: 13/668,264

(22) Filed: Nov. 3, 2012

(65) Prior Publication Data

US 2013/0175293 A1 Jul. 11, 2013

Related U.S. Application Data

(60) Provisional application No. 61/585,038, filed on Jan. 10, 2012.

(51) Int. Cl.
*D06F 35/00* (2006.01)
*D06F 39/02* (2006.01)
*D06F 39/12* (2006.01)

(52) U.S. Cl.
CPC ..... *D06F 39/022* (2013.01); *D06F 39/12* (2013.01)
USPC ..... 68/12.18; 68/17 R; 222/1; 222/23; 222/51; 222/80; 222/541.2; 8/158; 8/159

(58) Field of Classification Search
USPC ..... 222/129, 325, 1, 80–91, 541.2, 23, 25, 222/51; 68/12.18, 17 R; 8/158, 159
See application file for complete search history.

(56) References Cited

U.S. PATENT DOCUMENTS 5,839,454 A * 11/1998 Matz ..... 134/57 D
7,168,273 B2 * 1/2007 Neergaard et al. ..... 68/17 R
7,784,310 B1 * 8/2010 Bradford et al. ..... 68/12.18
7,921,578 B2 * 4/2011 McAllister et al. ..... 34/597
8,056,747 B2 * 11/2011 Vitan et al. ..... 220/23.83
8,122,743 B2 * 2/2012 Schulze ..... 68/17 R
8,312,745 B2 * 11/2012 Hasse et al. ..... 68/12.18
8,382,913 B2 * 2/2013 Classen et al. ..... 134/58 D
8,400,638 B2 * 3/2013 Dunsbergen et al. ..... 356/448
8,438,882 B2 * 5/2013 Rosenbauer ..... 68/28
2003/0116177 A1 * 6/2003 Appel et al. ..... 134/18
2003/0157723 A1 * 8/2003 Smith et al. ..... 436/43
2003/0204442 A1 * 10/2003 Marshall ..... 705/14
2004/0103696 A1 * 6/2004 Kim et al. ..... 68/17 R
2007/0000291 A1 * 1/2007 France et al. ..... 68/12.18
2010/0107704 A1 * 5/2010 Seo et al. ..... 68/17 R
2010/0161143 A1 * 6/2010 Smith et al. ..... 700/283
2010/0186460 A1 * 7/2010 Boldt et al. ..... 68/17 R
2010/0300155 A1 * 12/2010 Reinholz et al. ..... 68/137

FOREIGN PATENT DOCUMENTS

GB 2134078 A * 8/1984 ..... G01F 25/00

* cited by examiner

*Primary Examiner* — Kevin P Shaver
*Assistant Examiner* — Nicholas J Weiss
(74) *Attorney, Agent, or Firm* — Todd J. Langford; Eric A. Hanscom

(57) ABSTRACT

A cartridge system for dispensing substances into a washing machine is disclosed. One or more preferably different sized or shaped cartridges are located within removable drawers contained in a washing machine. Each cartridge contains a particular substance, such as laundry detergent, bleach, or fabric softener, that is released into the washing machine. The cartridge system also includes a means to identify the substance contained within the cartridge as well as when and how much of the substance should be released into the washing machine. At the appropriate time, the system dispenses an appropriate amount of substance into the washing machine. A pump pulls the substance out of the container and into the washing basin of a washing machine. Alternatively, a valve is opened and the substance pours into the washing basin due to gravitational forces.

19 Claims, 2 Drawing Sheets

CARTRIDGE SYSTEM FOR DISPENSING SUBSTANCES INTO A WASHING MACHINE

CROSS REFERENCE TO RELATED APPLICATIONS

This application claims the benefit of U.S. Provisional Pat. App. No. 61/585,038 filed Jan. 10, 2012, the entirety of which is hereby incorporated by reference.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of washing machines, and more specifically toward a cartridge used in a system for dispensing substances into a washing machine utilizing one or more cartridges that contain different substances commonly used in the process of washing clothes. The invention contemplates the use of a plurality of preferably different sized or shaped cartridges that are located within removable drawers. Each cartridge contains a particular substance, such as laundry detergent, bleach, or fabric softener, that is released into the washing machine. The washing machine system also includes a means to identify the substance contained within the cartridge as well as when and how much of the substance should be released into the washing machine, hence the cartridge contains a bar code or other readable indicia that communicates with a bar code reader or other reading device located in the washing machine. This bar code or other indicia allows the washing machine to determine whether the cartridge is an original cartridge with contents manufactured, or at least approved, by the company manufacturing the cartridge, or whether it is a re-filled, or even counterfeit cartridge. At the appropriate time, the washing machine dispenses an appropriate amount of substance into the washing machine from the cartridge. This can be accomplished through multiple means. First a pump could pull the substance out of the container and into the washing basin of a washing machine. Alternatively, a valve could be opened and the substance would then pour into the washing basin due to gravitational forces.

Washing machines enable users to wash their clothes in a shorter period of time and with greater ease than otherwise possible when doing it by hand. Whether it is a top loading or side loading washing machine, the clothes are soaked in water and agitated to get the clothes clean. Often, one or more substances such as laundry detergent, fabric softener, or bleach are added to the water to aid the cleaning process. However, how much of each substance and when it is added depends upon various factors, including the type of substance and the wash cycle set on the washing machine. Many users will place laundry detergent directly into the washing machine as it fills with water, then place fabric softener into a special container that releases the fabric softener at the appropriate time, and may also place bleach into yet another container that releases the bleach at its appropriate time.

Handling laundry detergent, fabric softener, bleach, or other common substances used to clean clothes can be unpleasant and even harmful. For example, bleach, which may include chlorine, is a respiratory irritant that attacks mucous membranes and can burn the skin. When adding these substances to the washing machine, either into the washing basin or into a separate receptacle, the amount of each substance must be measured. Pouring from a container into a measuring device, and then into the appropriate location in the washing machine often results in inadvertent spills as well as requiring that the measuring device be cleaned.

Thus there has existed a long-felt need for a system that dispenses an appropriate amount of a particular substance at the appropriate time into a washing machine without requiring a user to potentially come into contact with that substance. Furthermore, there is a need for a system that automatically dispenses a plurality of substances into a washing machine at the appropriate time during a wash cycle.

SUMMARY OF THE INVENTION

The current invention provides just such a solution by having a system for dispensing substances into a washing machine that relies upon a cartridge that has has been prefilled with a substance useful in the process of washing clothes. A plurality of preferably different sized or shaped cartridges are located within removable drawers in the washing machine. Alternatively, the cartridges can be stored in a stand-alone unit that can be purchased and retrofitted to an existing washing machine. Each cartridge contains a particular substance, such as laundry detergent, bleach, or fabric softener, that is released into the washing machine. The washing machine also includes a means to identify the substance contained within the cartridge as well as when and how much of the substance should be released into the washing machine, and the cartridge includes means of allowing the washing machine to identify the substance and the integrity of the cartridge. At the appropriate time, the washing machine dispenses an appropriate amount of substance into the washing machine. A pump pulls the substance out of the cartridge and into the washing basin of a washing machine. Alternatively, a valve is opened and the substance pours into the washing basin due to gravitational forces.

It is a principal object of the invention to provide a cartridge that enables users to safely, cleanly, and efficiently add substances to a washing machine.

It is another object of the invention to provide a cartridge that can be used for dispensing of one or more substances into a washing machine at the appropriate time.

It is a further object of this invention to provide a cartridge which provides a means by which a manufacturer of substances can try to ensure that a cartridge containing this substance cannot be refilled with a competitor's substance and resold.

It is an additional object of the invention to provide a cartridge where the delivery tube is directed not into the washing machine, but rather to a sprayer, where the sprayer can apply a substance, such as stain remover, to selected parts of selected items of clothing before the actual washing in the washing machine is begun.

It is yet another object of the invention to provide a dispensing system that is self-contained so as to eliminate pouring a substance form a separate container into a washing machine.

In a particular embodiment, the current invention is a cartridge that is used in a washing machine system for dispensing a substance into the washing machine comprising a plurality of cartridges, a plurality of level indicators, a plurality of barcode readers, a plurality of dispensing tubes, and a cover, where each cartridge comprises handle, a barcode, a vent, and a delivery tube adapter, where each of the plurality of dispensing tubes mates with a delivery tube of a cartridge, where a substance contained within each cartridge may flow through the delivery tube, where fluid that flows through the delivery tube is inserted into a washing machine, where each level indicator mates with the vent of a cartridge and determines the amount of substance contained within the cartridge, where each barcode reader reads data from a barcode of a cartridge and destroys the barcode of the cartridge, whereby the system for dispensing a substance dispenses a substance from each cartridge at a time and volume determined by the data read from the barcode of each cartridge.

In another embodiment, the current invention is a method of dispensing a substance into a washing machine comprising the steps of: acquiring a cartridge, having a washing machine accepting a cartridge, where the cartridge comprises a vent and a barcode; scanning the barcode of the cartridge; destroying the barcode of the cartridge such that it cannot be read again; inserting a level indicator through the vent and into the cartridge; and dispensing a substance contained within the cartridge into a washing machine; whereby data collected from scanning the barcode is used to determine the volume and timing of dispensing the substance contained within the cartridge into the washing machine.

In an additional embodiment, the current invention is a cartridge that can be used in a washing machine system for dispensing a substance comprising: a barcode reader, a level indicator, and a cartridge, where the cartridge comprises a vent and a barcode, where the barcode reader reads the barcode of the cartridge, where the barcode reader destroys the barcode of the cartridge after the barcode reader has read the barcode, where the level indicator is inserted through the vent and determines the level of a substance remaining within the cartridge.

In a further embodiment, the current invention is a cartridge system for dispensing a substance into a washing machine comprising: at least one cartridge, where the at least one cartridge comprises: six sides that define an inner space, a handle, a barcode, a vent, a delivery tube adapter, and a delivery tube, where the delivery tube adapter mates with the delivery tube, where a substance is contained within the inner space of the cartridge, where the substance may flow through the delivery tube, where the substance that flows through the delivery tube is inserted into a washing machine, where each barcode can contain three or more pieces data, where the three or more pieces of data relate to an identity of the substance, a delivery time which is the time during a washing machine cycle that the substance is to be delivered, and a delivery amount which is the amount of substance to be delivered.

In yet another embodiment, the current invention is a cartridge system for dispensing a substance into a washing machine comprising: at least one cartridge, where the at least one cartridge comprises: six sides that define an inner space, a handle, a barcode, a vent, a delivery tube adapter, and a delivery tube, where the delivery tube adapter mates with the delivery tube, where a substance is contained within the inner space of the cartridge, where the substance may flow through the delivery tube, where the substance that flows through the delivery tube is inserted into a washing machine, where each barcode can contain three or more pieces data, where the three or more pieces of data relate to an identity of the substance, a delivery time which is the time during a washing machine cycle that the substance is to be delivered, and a delivery amount which is the amount of substance to be delivered, further comprising a level indicator, where the level indicator mates with the vent of a cartridge, where the level indicator measures the amount of substance in the inner space, and displays one or more results from that measurement.

In an additional embodiment, the current invention is a cartridge system for dispensing a substance into a washing machine comprising: at least one cartridge, where the at least one cartridge comprises: six sides that define an inner space, a handle, a barcode, a vent, a delivery tube adapter, and a delivery tube, where the delivery tube adapter mates with the delivery tube, where a substance is contained within the inner space of the cartridge, where the substance may flow through the delivery tube, where the substance that flows through the delivery tube is inserted into a washing machine, where each barcode can contain three or more pieces data, where the three or more pieces of data relate to an identity of the substance, a delivery time which is the time during a washing machine cycle that the substance is to be delivered, and a delivery amount which is the amount of substance to be delivered, where the number of cartridges is at least two in number, where one of the cartridges comprises a sprayer, where the sprayer comprises a tube that extends from the delivery tube adapter to a spraying device, where the spraying device comprises a trigger that can be pulled to dispense a substance in the cartridge, a handle portion, where the handle portion is shaped like the grip on a handgun, and a dispensing nozzle, where a user can pull the trigger and dispense the substance onto clothes prior to the clothes being inserted into the washing machine.

In a further embodiment, the current invention is a method of dispensing a substance into a washing machine through a cartridge system, comprising the steps of: accepting a cartridge, where the cartridge comprises: six sides that define an inner space, a handle, a barcode, a vent, a delivery tube adapter, and a delivery tube, where the delivery tube adapter mates with the delivery tube, where a substance is contained within the inner space of the cartridge, where the substance may flow through the delivery tube, where the substance that flows through the delivery tube is inserted into a washing machine, where each barcode can contain three or more pieces data, where the three or more pieces of data relate to an identity of the substance, a delivery time which is the time during a washing machine cycle that the substance is to be delivered, and a delivery amount which is the amount of substance to be delivered; scanning the barcode of the cartridge; destroying the barcode of the cartridge such that it cannot be read again; inserting a level indicator through the vent and into the cartridge; and dispensing a substance contained within the cartridge into a washing machine; whereby data collected from scanning the barcode is used to determine the volume and timing of dispensing the substance contained within the cartridge into the washing machine.

In another particular embodiment, the current invention is a cartridge system for dispensing a substance comprising: a barcode reader, a level indicator, a cartridge, a second cartridge, a third cartridge, and a dispensing tube, where the cartridge comprises: six sides that define an inner space, a handle, a barcode, a vent, a delivery tube adapter, and a delivery tube, where the delivery tube adapter mates with the delivery tube, where a substance is contained within the inner space of the cartridge, where the substance may flow through the delivery tube, where the substance that flows through the delivery tube is inserted into a washing machine, where each barcode can contain three or more pieces data, where the three or more pieces of data relate to an identity of the substance, a delivery time which is the time during a washing machine cycle that the substance is to be delivered, and a delivery amount which is the amount of substance to be delivered; where the barcode reader reads the barcode of the cartridge, where the barcode reader destroys the barcode of the cartridge after the barcode reader has read the barcode, where the level indicator is inserted through the vent and determines the level of a substance remaining within the cartridge, wherein the cartridge further comprises a dispensing adapter, where the dispensing adapter of the cartridge mates with the dispensing tube, whereby a substance contained within the cartridge may flow through the dispensing adapter and through the dispensing tube, where the second cartridge and the third cartridge each comprise a barcode and a vent, where the second cartridge is smaller than the cartridge, where the third cartridge is smaller than the second cartridge, wherein the cartridge, second cartridge, and third cartridge each contain a substance, where the substance of the cartridge is laundry detergent, where the substance of the second cartridge is fabric softener, and where the substance of the third cartridge is bleach.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
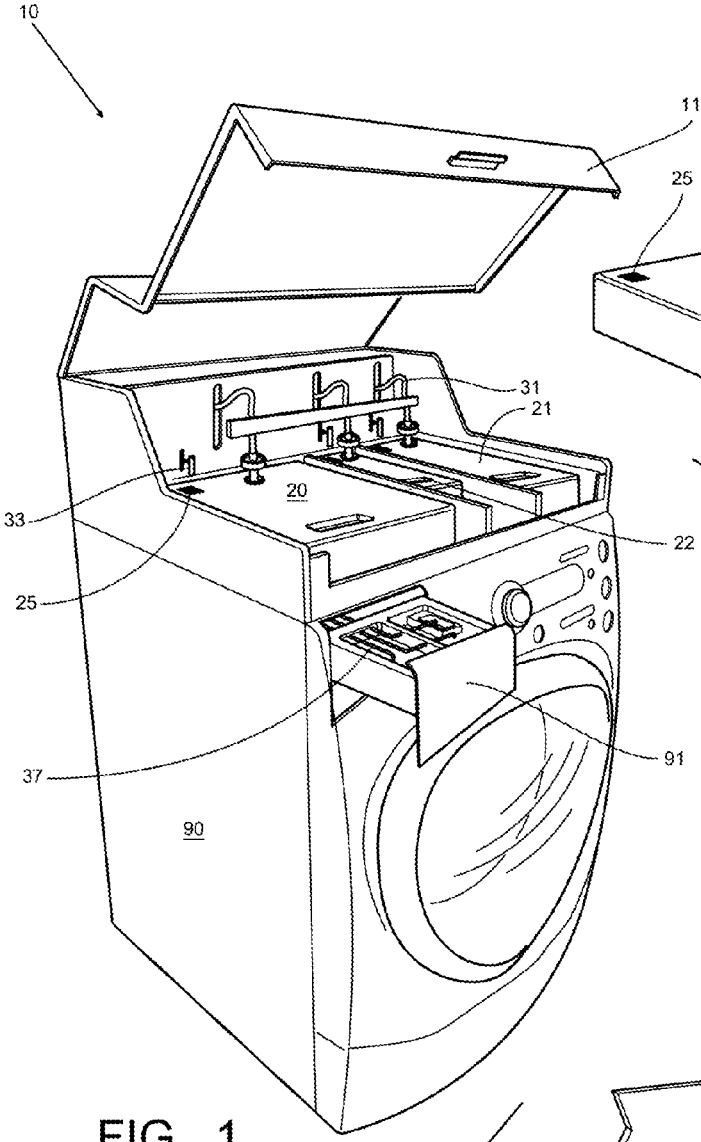
FIG. 1 is perspective view of a washing machine with a dispensing system illustrating the location of the cartridges, and some of the accessory parts of a washing machine that utilizes one of more of these cartridges to provide an efficient, clean and safe means by which a person can wash clothes.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 is perspective view of a washing machine with a dispensing system illustrating the location of the cartridges, and some of the accessory parts of a washing machine that utilizes one of more of these cartridges to provide an efficient, clean and safe means by which a person can wash clothes. A cartridge 20, as described in the claims of this application, is incorporated into a dispensing system 10 which resides on the top of a washing machine 90. In this particular illustration, cartridge 20 is a cartridge filled with detergent. The dispensing system 10 has a cover 11 that is connected to the back of the dispensing system 10 by a hinge. The dispensing system 10 accepts cartridges, such as a detergent cartridge 20, fabric softener cartridge 21, and a bleach cartridge 22. A level indicator 31 is used to determine the amount of fluid left within each cartridge. Barcode scanners 33 scan the barcode of each cartridge and then puncture (thereby destroying) each barcode after it is scanned. Described in more detail below, the barcode on the cartridge enables the dispensing system to determine what substance is in the cartridge as well as how much of and when to dispense the substance contained therein.

Figure 2:
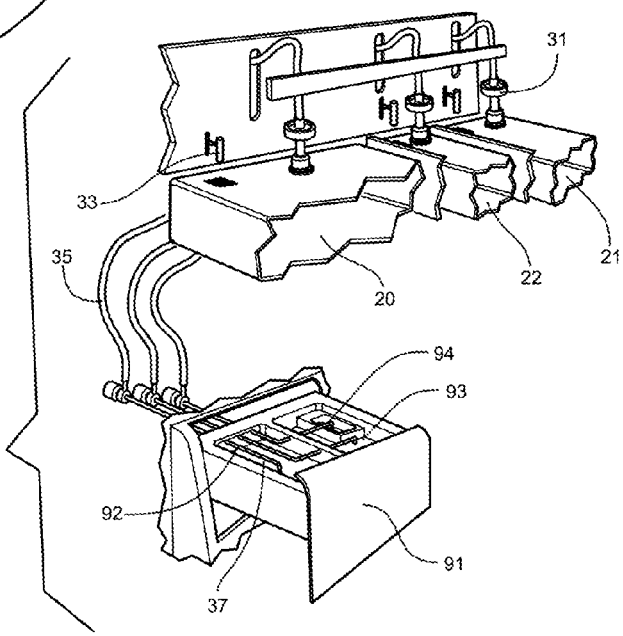
FIG. 2 is a partial view of the dispensing system of the washing machine and the integration of the cartridges into a drawer of a washing machine showing the attachment of the level indicators and delivery tubes in the cartridges.

FIG. 2 is a partial view of the dispensing system and its integration into a drawer of a washing machine according to selected embodiments of the current disclosure, which illustrate the role the cartridge plays in providing the proper amounts of a substance to the washing machine, and how the cartridge interacts with the overall washing machine system. After a cartridge is inserted into the dispensing system, barcode readers 33 scan the barcode (25 in FIG. 4) of each cartridge. After scanning the barcode, the barcode readers 33 move downward toward the cartridge and pierce each barcode thereby destroying it. By destroying the barcode, the dispensing system prevents repeated use (such as refilling) of the cartridges since the barcode reader 33 will not read a destroyed barcode. The prevention of reuse of the cartridge by a competitor of the manufacturer of the cartridge will optimize profits for the manufacturer by eliminating the opportunity for competitors with lower quality and lower priced substances can refill a cartridge, then resell the cartridge and diminish the reputation of the manufacturer due to having its label on an inferior substance.

Level indicators 31 are also lowered though a vent in each cartridge. In a particular embodiment, each cartridge has a cap that covers the vent, which is removed before it is inserted into the dispensing system. At the appropriate time, fluid from each cartridge is dispensed through delivery tubes 35 to dispensing tubes 37, which deposit the fluid in an appropriate area of a cleaning substance drawer 91 of a washing machine. The cleaning substance drawer 91 may include a detergent area 91, a fabric softener area 93, and a bleach area 94. The dispensing tubes 37 deposit the appropriate fluid into the appropriate area.

Figure 3:
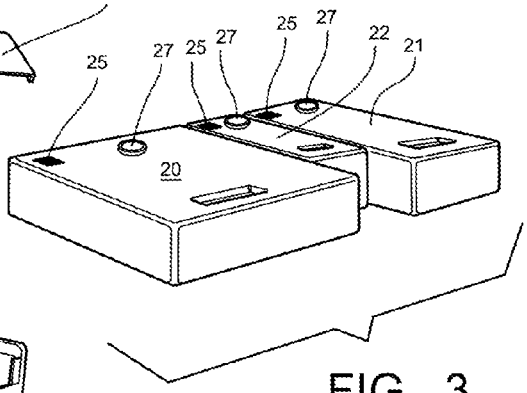
FIG. 3 is a perspective view of three cartridges according to selected embodiments of the current disclosure, showing how three cartridges, each of which contain a different substance, would be aligned in the drawers of a washing machine.

FIG. 3 is a perspective view of three cartridges according to selected embodiments of the current disclosure, showing how three cartridges, each of which contain a different substance, would be aligned in the drawers of a washing machine. Three cartridges are shown in this embodiment: a detergent cartridge 20, fabric softener cartridge 21, and a bleach cartridge 22. The detergent cartridge 20 contains laundry detergent and is the largest of the three cartridges shown. The fabric softener cartridge 21 contains fabric softener and is the second largest cartridge shown. The bleach cartridge 22 is the smallest cartridge shown and contains bleach. Each cartridge includes a vent 27 that is covered with a cap (not shown) when stored or otherwise not in use and not inserted within the dispensing system. A barcode 25 is also placed on each cartridge, which is used to identify the particular substance contained within the cartridge and the particular use instructions associated therewith.

Figure 4:
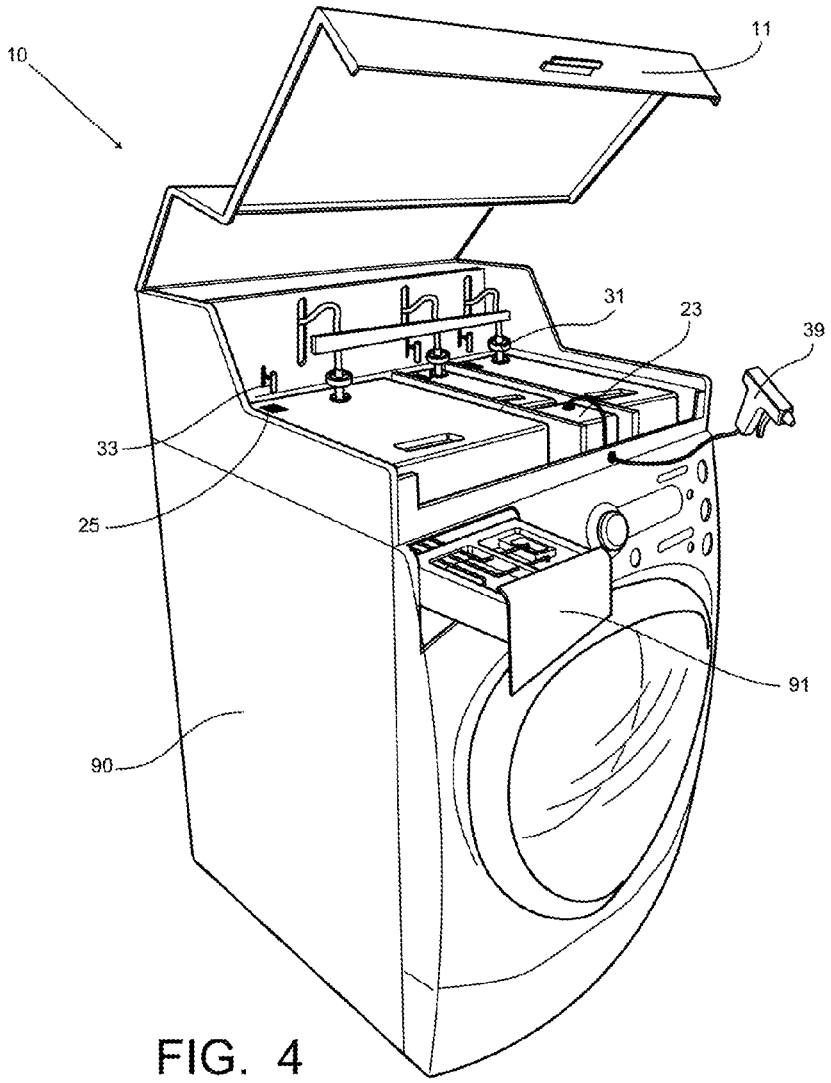
FIG. 4 is a perspective view of a washing machine with a dispensing system and integrated stain remover sprayer according to selected embodiments of the current disclosure.

FIG. 4 is a perspective view of a cartridge with an integrated stain remover sprayer according to selected embodiments of the current disclosure. The washing machine dispensing system 10, in addition to a detergent cartridge, fabric softener cartridge, and bleach cartridge, may include a stain remover cartridge 23. The stain remover cartridge 23 is designed to allow a user to spray stain remover on particularly dirty portions of clothes. A tube extends therefrom and through an opening in the dispensing system and is connected to a sprayer 39. The sprayer 39 includes a trigger, which can be pulled to dispense a stain remover substance contained within the stain remover cartridge 23. Thus, a user may quickly and efficiently treat a stained item of clothing by using the sprayer 39 integrated with the dispensing system 10.

Figure 5:
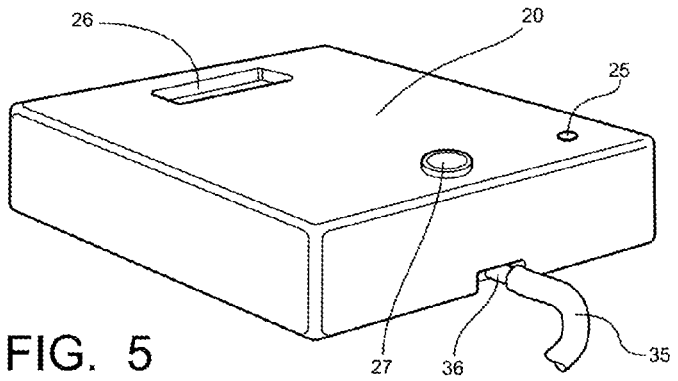
FIG. 5 is a perspective view of a cartridge according to selected embodiments of the current disclosure, illustrating its key features.

FIG. 5 is a perspective view of a cartridge according to selected embodiments of the current disclosure, illustrating its key features. The cartridge 20, in this case in the shape of a detergent cartridge, includes a handle 26 that is used to grasp the detergent cartridge. A vent 27 is an opening that is used to allow air to enter the detergent cartridge 20 as the substance contained therein is withdrawn. A level indicator (not shown in this figure) may also extend through the vent opening 27 to measure the amount of substance remaining in the detergent cartridge 20. A barcode 25 identifies that particular substance within the detergent cartridge 20. The substance within the detergent cartridge 20 is withdrawn through a delivery tube 35. The delivery tube mates with the detergent cartridge 20 via a delivery tube adapter 36. As the detergent cartridge 20 is inserted into the dispensing system, the delivery tube 35 mates the delivery tube adapter 36, which is integrated into the detergent cartridge.

The level indicators are inserted through the vent and are used to determine the amount of substance remaining in the particular cartridge. A float moves up and down depending on the level of the substance (fluid) in the cartridge. In other words, as the substance is removed from the cartridge, the float travels downward. Sensors determine the location of the float, and through this the relative amount of substance left in the cartridge.

In a particular embodiment, the dispensing system includes fluid pumps. The fluid pumps are in fluid connection with the cartridges via delivery tubes. Each fluid pump 50 is in electrical connection to a circuit board, such as a motherboard of the dispensing system or washing machine. Solenoid valves may also be utilized to block and unblock the flow of the fluid from the cartridge and to the washing machine cleaning substance drawer. In this manner, the fluid pump and/or solenoid valves are turned on and off as directed by the internal circuitry of the system and/or washing machine.

In another embodiment, the dispensing system lacks fluid pumps, and the substance flows from the cartridge through gravity. It is also contemplated that the drawer section of the washing machine could be tilted, or adjustably tilted, such that the gravitational flow is enhanced.

In another embodiment, the washing machine has drawer capacity to accept four different cartridges, including a stain removing cartridge with an integrated stain remover sprayer. The stain remover cartridge has a sprayer at the end of a tube which is connected to the stain remover cartridge. The sprayer includes a trigger, which can be pulled to dispense a stain remover substance contained within the stain remover cartridge. Thus, a user may quickly and efficiently treat a stained item of clothing by using the sprayer integrated with the dispensing system. It is also contemplated that more than four cartridges could be inserted into one or more drawers in the washing machine.

In another embodiment, the barcode includes data such as the type of substance within the cartridge, volume of the cartridge, manufacturing date, serial number, or codes or encrypted data that verifies the source and authenticity of the laundry detergent cartridge. By checking the data on the barcode of the cartridge, the system ensures that only compatible cartridges manufactured for the system will dispense the substance contained therein. Furthermore, the appropriate volume and timing of the substance to be dispensed is automatically read in by the system and implemented accordingly, thereby reducing user error.

In an alternative embodiment, the barcode includes only encrypted identifying data that is used to query a remote network connected server. By way of example, the barcode reader reads in the data from the barcode. It then uses this data to make a request to a remote server over the internet. The request is made as an http request made over a Wi-Fi-network that is connected to the internet. The data from the barcode, either encrypted or decrypted, is transmitted to the remote server, which then responds with various data related to the cartridge. The response data may include confirmation as to whether or not the cartridge is authentic, whether or not the cartridge has been used previously, the substance located within the cartridge, the amount of substance that should be dispensed per load of laundry, at what point in the cycle the substance should be dispensed, and how much substance is located within the cartridge.

The laundry detergent cartridge includes a vent, handle, and a barcode. The length of the laundry detergent cartridge of a particular embodiment is 14.5 inches, where the handle is 2.5 inches and the remaining portion is 12 inches, and the width of the laundry detergent cartridge is 5.875 inches.

In an alternative embodiment, the laundry detergent cartridge has a generally trapezoidal shape, where the width of the top part is 5.875 inches and the width of the bottom part is 5.0625 inches. The height of the laundry detergent cartridge is 5.5 inches. The trapezoidal shape helps ensure that the laundry detergent cartridge has the proper orientation when it is placed into the dispensing system. Notches in the laundry detergent cartridge may be used to align the laundry detergent cartridge in the appropriate position and location in the dispensing system.

A vent cap allows for air to vent into a cartridge as the substance contained within is removed from the cartridge. The vent cap may be a screw-type cap, wherein the vent cap is placed over a vent and screwed into position. When screwed shut, the vent cap closes the vent. When vent cap is unscrewed, the vent is opened and air is allowed to pass therethrough. Without venting the cartridge, fluid would not easily flow out of the cartridge and through the delivery tube.

The fabric softener cartridge is smaller than the laundry detergent cartridge. Often, more laundry detergent is used than fabric softener per load of laundry. Therefore, the fabric softener cartridge needs to hold less fabric softener than the laundry detergent cartridge needs to hold laundry detergent. In this particular embodiment, the main part of the fabric softener cartridge is 7.125 inches long and 3.5 inches wide. The fabric softener cartridge also includes a handle for grasping and maneuvering the fabric softener cartridge and a vent cap for allowing air to vent into the fabric softener cartridge as fabric softener is removed from the fabric softener cartridge.

In an alternative embodiment, the fabric softener cartridge has a generally trapezoidal shape, where the width of the top part is 3.5 inches. The height of the fabric softener cartridge is 5.25 inches. The trapezoidal shape helps ensure that the fabric softener cartridge has the proper orientation when it is placed into the dispensing system. Notches in the fabric softener cartridge align the fabric softener cartridge in the appropriate position and location in the dispensing system.

In a particular embodiment, the laundry detergent cartridge holds 170 oz. of laundry detergent and the bleach cartridge holds 5 oz. of bleach.

In practice, a user who has purchased one or more cartridges, opens the lid to the dispensing system, removes the vent cap that covers the vent of a cartridge, and then inserts the cartridge into the dispensing system. The user then closes the lid and the dispensing system reads in the barcode located on the cartridge, verifies its authenticity, and then punctures the barcode making it unreadable in the future. If necessary and enabled, the dispensing system queries a remote server for additional information on the cartridge, such as type of substance, size of the container, and dispensing instructions. At the same time or subsequent to reading the barcode, level indicators are inserted through the vent to read in the level of substance remaining within the cartridge.

Should the user find an unusually large amount of stain on a particular item of clothing, the user can use the sprayer portion of the stain remover cartridge to spray stain remover on the dirty portions prior to starting the normal wash cycle.

The user will then place dirty laundry into the washing machine, and start a washing cycle. The dispensing system dispenses an appropriate amount of the substance contained within the cartridge into the washing machine at the appropriate time. For example, a first substance may be deposited into the cleaning substance drawer of the washing machine when the cleaning cycle begins, while a second substance is deposited fifteen minutes after the cycle beings, and then a third substance is deposited 5 minutes before the cleaning cycle ends.

Multiple loads of laundry may be run for each cartridge. When the level indicators determine that there is little substance left within a particular cartridge, such as substance for five or fewer loads, a user is notified. Notifications include without limitation a blinking light, illuminated light, a beep, a buzz, a text message, an email, or red/yellow/green lights and/or bars.

After a cartridge is empty, the user opens the lid of the dispensing system. As the lid is opened, the level indicators are removed from each cartridge and the user may grasp the handle of the empty cartridge and remove it from the dispensing system. If each cartridge is designed to deliver substance for the same number of loads of laundry, and not necessarily the same amount of substance, then all of the cartridges should need to be replaced at roughly the same time.

The system described herein has been shown with three different sized cartridges. One skilled in the art will appreciate that fewer or more than three cartridges of the same or different substances may be implemented. For example, a four-cartridge system may be used where four different substances are desired to automatically dispense into the washing machine. Furthermore, multiple cartridges of the same type and/or size and shape (such as multiple laundry detergent cartridges) may be implemented into the system. Additionally, gravity or pressure pumps may be used to move the fluid substance contained within the cartridge.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A cartridge system for dispensing a substance into a washing machine comprising:

a cartridge and a delivery tube, where the cartridge comprises:

six sides that define an inner space, a handle, a barcode, a vent, and a delivery tube adapter, where the delivery tube adapter mates with the delivery tube, where the substance is contained within the inner space of the cartridge, where the substance may flow through the delivery tube, where the substance that flows through the delivery tube is inserted into the washing machine, where the barcode includes three or more pieces of data, where the three or more pieces of data comprise an identity of the substance, a delivery time which is the time during a washing machine cycle that the substance is to be delivered, and a delivery amount which is the amount of substance to be delivered, further comprising a barcode reader, where the barcode reader reads data from the barcode of the cartridge, where the barcode reader, comprising an elongated protrusion, destroys the barcode on the cartridge after reading the barcode.

2. The cartridge system of claim 1, further comprising a level indicator, where the level indicator mates with the vent of the cartridge.

3. The cartridge system of claim 2, where the level indicator measures the amount of the substance in the inner space, and displays one or more results from that measurement.

4. The cartridge system of claim 1, further comprising a second cartridge.

5. The cartridge system of claim 4, further comprising a sprayer, where the sprayer comprises a tube that extends from the second cartridge to a spraying device, where the spraying device comprises a trigger and a handle portion, where the trigger is pulled to dispense a second substance in the second cartridge, where the handle portion is shaped like the grip on a handgun.

6. The cartridge system of claim 5, where the second substance is stain remover.

7. The cartridge system of claim 5, wherein the cartridge and the second cartridge each holds a different substance.

8. The cartridge system of claim 7, wherein the cartridge and the second cartridge each holds a different internal volume.

9. The cartridge system of claim 1, wherein the cartridge further comprises a vent cap, where the vent cap must be removed before inserting the cartridge into the system.

10. A method of dispensing a substance into a washing machine through a cartridge system, comprising the steps of:

accepting a cartridge, where the cartridge comprises:

six sides that define an inner space, a barcode, a vent, and a delivery tube adapter, where the delivery tube adapter mates with a delivery tube, where the substance is contained within the inner space of the cartridge, where the substance may flow through the delivery tube, where the substance that flows through the delivery tube is inserted into the washing machine, where the barcode includes three or more pieces of data, where the three or more pieces of data comprise an identity of the substance, a delivery time which is the time during a washing machine cycle that the substance is to be delivered, and a delivery amount which is the amount of substance to be delivered;

scanning the barcode of the cartridge;

destroying the barcode of the cartridge such that it cannot be read again;

inserting a level indicator through the vent and into the cartridge; and dispensing the substance contained within the cartridge into the washing machine;

whereby data collected from scanning the barcode is used to determine the volume and timing of dispensing the substance contained within the cartridge into the washing machine.

11. The method of claim 10, wherein the cartridge further comprises a handle.

12. The method of claim 10, further comprising the steps of:

accepting a second cartridge, where the second cartridge comprises a vent and a barcode, where a second substance is contained within the second cartridge;

scanning the barcode of the second cartridge;

destroying the barcode of the second cartridge such that it cannot be read again;

inserting a level indicator through the vent and into the second cartridge; and dispensing the substance contained within the second cartridge into the washing machine;

whereby data collected from scanning the barcode of the second cartridge is used to determine the volume and timing of dispensing the second substance contained within the second cartridge into the washing machine.

13. The method of claim 12, wherein the substance within the cartridge is different than the second substance contained within the second cartridge.

14. The method of claim 12, wherein the substance of the cartridge is dispensed at a different time than the second substance of the second cartridge.

15. The method of claim 12, wherein the volume of the substance dispensed from the cartridge is different than the volume of the second substance dispensed from the second cartridge.

16. A cartridge system for dispensing a substance comprising:

a barcode reader, a level indicator, a cartridge, a dispensing tube, and a delivery tube, where the cartridge comprises six sides that define an inner space, a handle, a barcode, a vent, and a delivery tube adapter, where the delivery tube adapter mates with the delivery tube, where the substance is contained within the inner space of the cartridge, where the substance may flow through the delivery tube, where the substance that flows through the delivery tube is inserted into a washing machine, where the barcode includes three or more pieces of data, where the three or more pieces of data comprise an identity of the substance, a delivery time which is the time during a washing machine cycle that the substance is to be delivered, and a delivery amount which is the amount of substance to be delivered;

where the barcode reader reads the barcode of the cartridge, where the barcode reader, comprising an elongated protrusion, destroys the barcode of the cartridge after the barcode reader has read the barcode, where the level indicator is inserted through the vent and determines the level of the substance remaining within the cartridge, where the delivery tube mates with the dispensing tube, whereby a substance contained within the cartridge may flow through the delivery tube and through the dispensing tube, where the cartridge system further comprises a second cartridge and a third cartridge, where the second cartridge and the third cartridge each comprise a barcode and a vent, where the second cartridge is smaller than the cartridge, where the third cartridge is smaller than the second cartridge, wherein the second cartridge contains a second substance and the third cartridge contains a third substance, where the substance of the cartridge is laundry detergent, where the second substance is fabric softener, and where the third substance is bleach.

17. The cartridge system of claim 1, wherein the barcode reader destroys the barcode by piercing the barcode.

18. The method of claim 10, wherein the step of destroying the barcode of the cartridge such that it cannot be read again comprises piercing the barcode.

19. The cartridge system of claim 16, wherein each barcode reader destroys the barcode of the cartridge by puncturing the barcode.

* * * * *